US007007598B1

(12) United States Patent
Patras

(10) Patent No.: US 7,007,598 B1
(45) Date of Patent: Mar. 7, 2006

(54) PUBLIC ACCESS TRASH COMPACTOR

(76) Inventor: Daniel Patras, 17 Marsh Hill, Putnam Valley, NY (US) 10579

( * ) Notice: Subject to any disclaimer, the term of this patent is extended or adjusted under 35 U.S.C. 154(b) by 29 days.

(21) Appl. No.: 10/727,480

(22) Filed: Dec. 4, 2003

(51) Int. Cl.
*B30B 13/00* (2006.01)
*B30B 15/30* (2006.01)

(52) U.S. Cl. ..... 100/35; 100/45; 100/49; 100/99; 100/215; 100/226; 100/229 A

(58) Field of Classification Search ..... 100/35, 100/45, 49, 99, 214, 215, 229 R, 226, 229 A; 220/908, 908.3; 232/43.3, 44, 45, 47, 49
See application file for complete search history.

(56) References Cited

U.S. PATENT DOCUMENTS

| | | | | |
|---|---|---|---|---|
| 3,669,009 | A | 6/1972 | Pratt | |
| 3,727,546 | A | 4/1973 | McKinney | |
| 3,785,278 | A | 1/1974 | Hopkins | |
| 3,831,513 | A | 8/1974 | Tashman | |
| 3,861,297 | A | 1/1975 | Considine | |
| 3,869,978 | A | 3/1975 | Steinberg | |
| 3,885,467 | A | 5/1975 | Merkin | |
| 3,901,139 | A | 8/1975 | Moriconi | |
| 3,916,782 | A | 11/1975 | Booton | |
| 3,922,962 | A | 12/1975 | Goldkuhle | |
| 3,945,314 | A | 3/1976 | Hennells | |
| 4,005,648 | A | 2/1977 | Edwards | |
| 4,147,100 | A | 4/1979 | Dykstra | |
| 4,156,386 | A * | 5/1979 | Gould | 100/215 |
| 4,436,026 | A * | 3/1984 | Imamura et al. | 100/45 |
| 4,466,357 | A * | 8/1984 | Masachika | 109/66 |
| 4,512,252 | A | 4/1985 | Goldhammer | |
| 4,658,720 | A | 4/1987 | Massonnet | |
| 4,706,560 | A * | 11/1987 | Capodicasa | 100/102 |
| 4,715,498 | A * | 12/1987 | Hanifl | 206/366 |
| 4,890,733 | A * | 1/1990 | Anderson | 206/365 |
| 4,896,593 | A | 1/1990 | Slusser | |
| 4,914,340 | A | 4/1990 | Fox | |
| 5,001,978 | A * | 3/1991 | Discepolo | 100/215 |
| 5,137,212 | A * | 8/1992 | Fiterman et al. | 232/43.2 |
| 5,448,945 | A * | 9/1995 | Taylor et al. | 100/100 |
| 5,517,907 | A | 5/1996 | Fox | |
| 5,588,358 | A | 12/1996 | Klepacki | |
| 2002/0108507 | A1 * | 8/2002 | May et al. | 100/45 |

FOREIGN PATENT DOCUMENTS

| | | | |
|---|---|---|---|
| JP | 54129762 | A * | 10/1979 |
| JP | 54146474 | A * | 11/1979 |

* cited by examiner

*Primary Examiner*—Lowell A. Larson
*Assistant Examiner*—Jimmy Nguyen
(74) *Attorney, Agent, or Firm*—Seth Natter; Natter & Natter

(57) ABSTRACT

A trash compactor includes a loading vestibule which extends forwardly of a cabinet. Pivotally mounted to a lower edge of the vestibule entrance is a carriage having a panel which functions as a vestibule lid. When the lid is pivoted downwardly, a distal panel of the carriage pivots upwardly, blocking access to a trash discharge outlet. Trash is then loaded on the carriage. When the lid is closed, the distal panel is sloped downwardly to an angle which discharges the trash through the discharge outlet and into a trash compaction compartment. An overhead compaction mechanism includes a reciprocating ram which compresses the trash in the compaction compartment.

18 Claims, 3 Drawing Sheets

PUBLIC ACCESS TRASH COMPACTOR

BACKGROUND OF THE INVENTION

1. Field of the Invention

This invention relates generally to trash and waste collection and to receptacles for the deposit of trash, waste and other refuse by members of the general public. More specifically, the invention relates to trash compaction systems for use by the general public.

2. Antecedents of the Invention

Throughout the ages, the disposal of trash, waste and refuse was a problem which required addressing. Increasing environmental regulations and constraints as to disposal, e.g. incineration restrictions, landfill restrictions, etc., as well as demands for increasing the collection, efficiency, safety and temporary storage of trash, waste and other refuse prior to disposal have been of major concern.

Development in the areas of collection and treatment of trash, waste and refuse prior to collection by commercial or public trash haulers has been considered from cost, space and efficiency standpoints, as well as from the standpoints of sanitation, health, odor and pest control.

While trash compaction systems have been in usage, such systems were relegated to commercial installations, primarily due to size, cost and operator safety constraints. Such systems comprised a hydraulic compaction mechanism which included a cylinder having a piston rod and a trash compaction ram or plate fixed to the end of the piston rod. A motor was employed to drive a hydraulic fluid pump and a fluid control system actuated fluid flow into the cylinder, resulting in movement of the piston to force the ram against the trash or refuse to be compacted and subsequently withdrawal of the ram so that additional trash may be deposited over the compacted trash.

Among the major concerns in connection with the design of such systems was operator safety, i.e. avoidance of inadvertent engagement between an operator body appendage, clothing, etc. and the compaction mechanism, as well as controls against the placement of inappropriate objects in the compacting unit, e.g. objects too large, objects not designed or otherwise unsafe for compaction, e.g. metal objects, hazardous materials, etc.

Since the prior systems were primarily designed for industrial or commercial applications, wherein trained operators were employed to load the compactor and operate the compaction mechanism, operator safety training was heavily relied upon.

With public safety of paramount consideration, public use trash collection systems employed at public access areas, e.g. amusement parks, fast food restaurants, public streets, parks and other facilities, comprised either an open container lined with a plastic trash bag or a container lined with a plastic trash bag having a lid with an access opening. Since the material deposited in the container was not compacted, labor costs of frequent bag removal were incurred. Further, because the waste collected in these containers, particularly food waste, was accessible to pests, scavengers and the like, employment of such containers included concomitant pest control issues as well as scavenger problems, wherein collected trash became strewn about by the scavenger in search of food or some other thing of perceived value.

The need was apparent for a cost effective public access trash collection system wherein deposited trash would be inaccessible to the public, pests and scavengers and which compacted the deposited trash for more efficient handling, while at the same time maintaining public safety by minimizing the potential for injury resulting from operation of a compaction mechanism.

SUMMARY OF THE INVENTION

A front-loading public access trash compactor includes a cabinet having front, side and rear panels arrayed with an upper compaction machinery compartment and a lower compaction compartment, within which trash is compacted. The front panel includes a forwardly extending trash loading vestibule having a trash loading entrance at one end and a trash discharge outlet at its opposite end.

A biplanar unitary load carriage is pivotally mounted at a lower edge of the trash loading entrance, with a proximal panel of the carriage functioning as a lid, selectively closing the trash loading entrance.

When the proximal panel is pivoted downwardly to open the entrance, a distal panel of the carriage rotates upwardly, blocking the user's access to the trash discharge outlet.

Trash is then loaded onto the carriage, resting upon the inner face of the proximal panel and upon the distal panel.

When the trash loading entrance is closed, the distal panel is sloped downwardly to an angle which discharges the trash load through the discharge outlet and into the cabinet. The trash load then falls into a container positioned in the compaction compartment.

A system controller is coupled to a plurality of sensors for monitoring the status of the carriage position, controlling a latch to prevent opening the lid when the compaction mechanism is operating and when the container is full, monitoring the status of the compaction mechanism, monitoring the status of trash collected in the container, actuating the compaction mechanism and generating a signal for trash pickup.

The trash compactor is also equipped with alternate power supply sources.

From the forgoing compendium, it will be appreciated that it is an aspect of the present invention to provide a public access trash compactor of the general character described which is not subject to the disadvantages of the antecedents of the invention aforementioned.

It is a feature of the present invention to provide a public access trash compactor of the general character described which is safe for use by members of the general public.

A consideration of the present invention is to provide a public access trash compactor of the general character described, the operation of which is economical.

Another feature of the present invention is to provide a public access trash compactor of the general character described which is relatively low in cost.

An additional aspect of the present invention is to provide a public access trash compactor of the general character described which is easy to use.

A further consideration of the present invention is to provide a public access trash compactor of the general character described which reduces costs related to frequent emptying of trash containers.

To provide a public access trash compactor of the general character described which is well suited for economical mass production fabrication is a still further aspect of the present invention.

Another feature of the present invention is to provide a public access trash compactor of the general character described having a cabinet housing, a compaction mechanism and a container for the collection of trash within a cabinet wherein the cabinet interior is inaccessible to the public.

A still further consideration of the present invention is to provide a public access trash compactor of the general character described wherein the public may deposit only trash loads of predetermined maximum size.

Yet another aspect of the present invention is to provide a public access trash compactor of the general character described which includes a pivotable load carriage for depositing trash.

Yet another feature of the present invention is to provide a public access trash compactor of the general character described featuring automatic trash compaction.

To provide a public access trash compactor of the general character described which is effective for pest control in public areas is a still further aspect of the present invention.

To provide a public access trash compactor of the general character described which generates a signal indicating the need for collection of compacted trash is a further consideration of the present invention.

Yet another aspect of the present invention is to provide a public access trash compactor of the general character described which renders deposited trash inaccessible to scavengers.

Providing a public access trash compactor of the general character described which is unobtrusive and public user friendly is a still further feature of the present invention.

Another aspect of the present invention is to provide a public access trash compactor of the general character described which is well suited for free standing use in public areas wherein direct connection to an electrical supply line is unavailable.

Yet another consideration of the present invention is to provide a public access trash compactor of the general character described which eliminates the need for frequent emptying.

To provide a public access trash compactor of the general character described which is portable for strategic placement in public areas during special events is a still further aspect of the present invention.

Another feature of the present invention is to provide a public access trash compactor of the general character described having a cabinet and a trash loading entrance wherein access to the interior of the cabinet is automatically blocked when the trash loading entrance is accessed.

A still further consideration of the present invention is to provide a public access trash compactor of the general character described which includes a safety interlock for preventing access to a trash loading entrance when a compaction mechanism is in operation.

Other aspects, features and considerations in part will be obvious and in part will be pointed out hereinafter.

With these ends in view, the present invention finds embodiment in the various combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which one of the various possible exemplary embodiments of the invention are shown.

DESCRIPTION OF THE PREFERRED EMBODIMENTS

Figure 1:
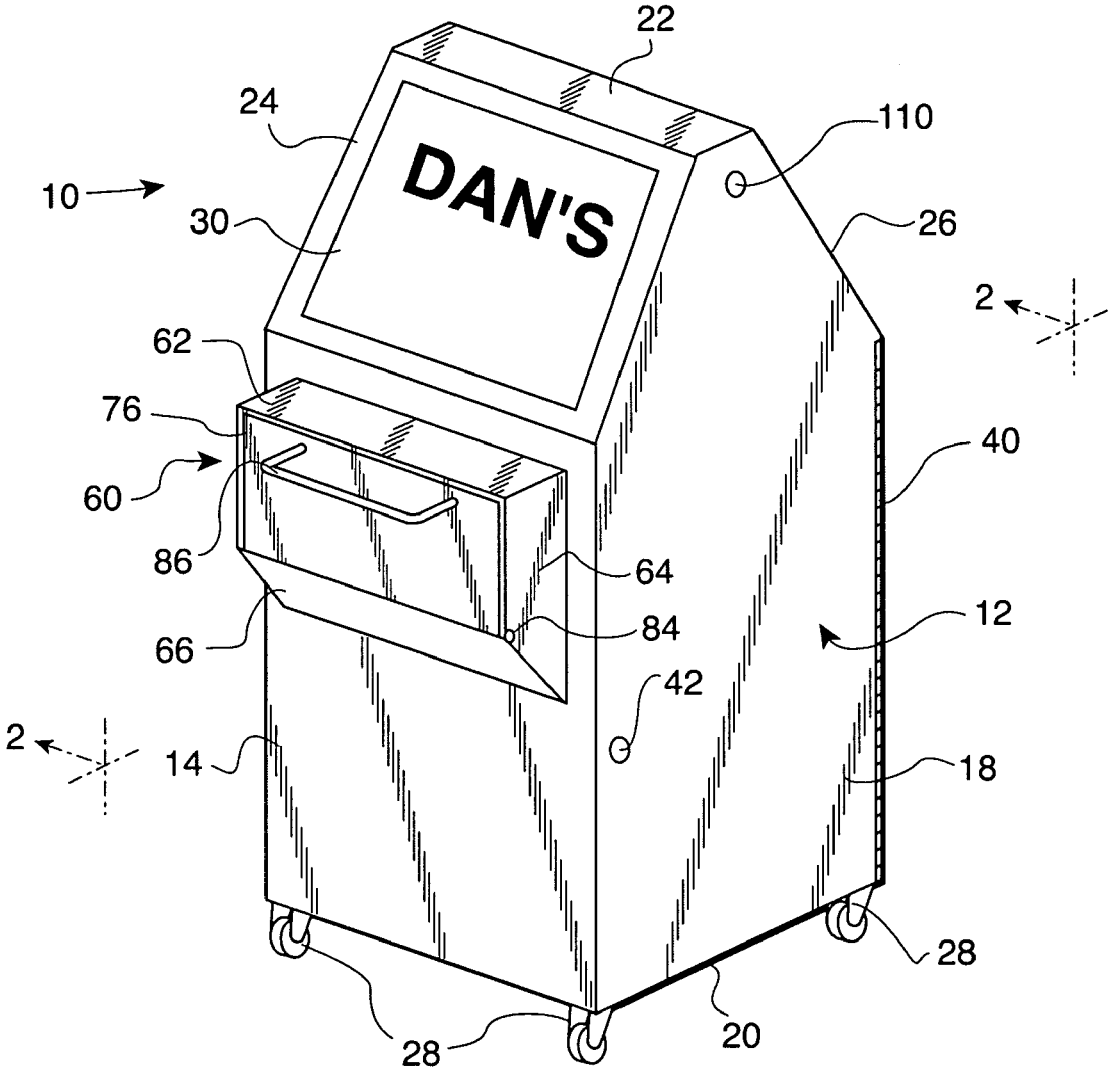
FIG. 1 is a perspective illustration of a public access trash compactor constructed in accordance with and embodying the invention and illustrating a cabinet having a trash-loading vestibule.

Referring now in detail to the drawings, the reference numeral 10 denotes generally a public access trash compactor constructed in accordance with and embodying the invention. As employed hereinafter, the term "trash" should be construed to encompass all manner of refuse, waste, rubbish and the like.

The compactor 10 may comprise a freestanding cabinet 12 having a front panel 14, a rear panel 16, side panels 18, a bottom panel 20 and a top panel 22. The front and rear panels 14, 16 may include inwardly sloped upper sections 24, 26. As will be noted from the drawing figures (FIG. 1 and FIG. 2), all of the components of the compactor 10 are self-contained within the cabinet 12.

As will be noted from an examination of FIG. 1, a plurality of optional casters 28 may be affixed to the bottom panel 20 to facilitate portability. Advertising signage 30 as appearing in the upper section 24, may be positioned on one or both of the upper sections. An auxiliary power supply solar panel 32, as appearing on the upper section 26, may be mounted to one or both of the upper sections.

In accordance with the invention, the cabinet 12 includes an upper compaction machinery compartment 34 and a lower trash compaction compartment 36, within which a trash container 38 is positioned. The trash container 38 is preferably lined with a plastic trash bag for ease of removal of compacted trash.

To facilitate removal of the container 38 for the collection of compacted trash, as well as for servicing compaction machinery and controls, one of the panels, e.g. a side panel 18, comprises an access door and is connected to the remaining cabinet panels by a hinge 40 and is opened by accessing a safety lock 42.

The compaction machinery compartment 34 houses a hydraulic cylinder 44 which carries a reciprocating piston 46 having a compaction ram or plate 48 at its lower end. The movement of the piston 46 is controlled by a motor operated hydraulic pump 50, which draws hydraulic fluid from a suitable reservoir 52, in a manner well known to those of skill in the art. Alternate compaction mechanisms may be employed including, for example, a mechanical rack engaged by a motor driver pinion through a suitable gear train.

In accordance with the invention, positioned adjacent the upper end of the front panel 14 is a forwardly extending trash loading vestibule 60. The vestibule 60 includes a generally planar top 62, a pair of parallel sides 64 and a downwardly sloped bottom 66. The forward edges of the top, sides and bottom define a generally rectangular trash loading entrance 68.

The interior of the vestibule 60, from the trash loading entrance 68 to a lower elevation discharge outlet 70, which extends through the front panel 14, constitutes a passageway which is defined by the interior faces of the sides 64 and an upper curved arch panel 72 having a smooth surface which promotes the downward flow of trash.

Pursuant to the invention, there is provided a biplanar unitary load carriage 74 having a proximal panel 76, which functions as a lid selectively closing the trash loading entrance 68, and a distal panel 78. The panels 76, 78 intersect at a juncture axis 80 and are inclined with respect to one another at an obtuse angle.

A journal 82 projects laterally from the sides of the carriage at the juncture axis 80 with each journal being seated in a respective aperture or bearing 84 in the sides 64. The carriage 74 is thus mounted for rotation relative to the vestibule 60 about its juncture axis 80.

It should be noted that the proximal panel or lid 76 includes a suitable hand grip 86 and may also include a curved flange 88, which extends the length of its upper edge. The purpose and function of the flange 88 will be described hereinafter.

Figure 2:
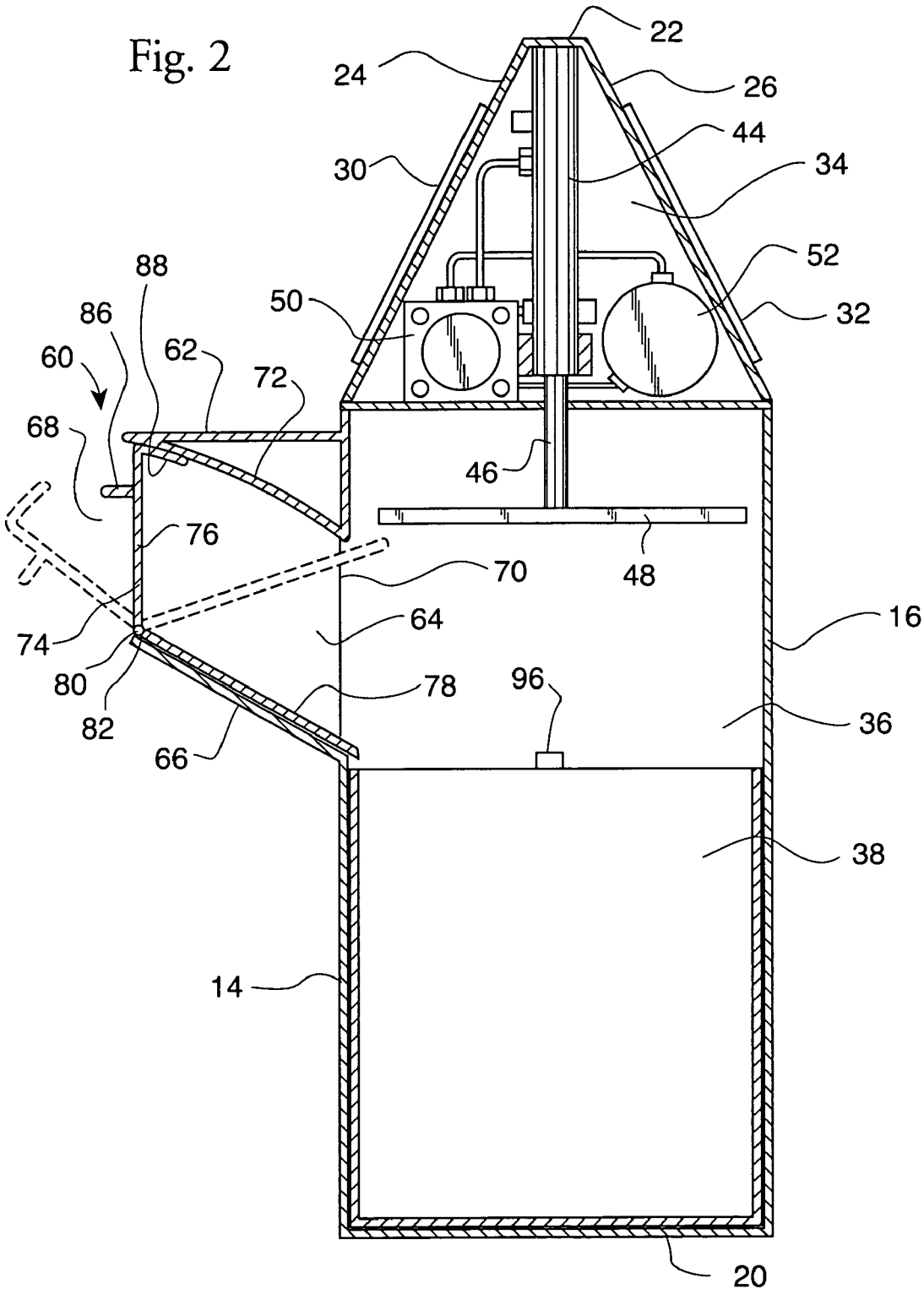
FIG. 2 is an enlarged scale sectional view through the compactor, the same being taken substantially along the plane 2—2 of FIG. 1 and illustrating the vestibule including a trash loading entrance, a trash discharge outlet and a pivotally mounted trash carriage.

It should be appreciated, from the examination of FIG. 2, that with the carriage 74 positioned such that the proximal panel or lid 76 is vertical, i.e. closing the vestibule trash loading entrance, the distal panel 78 of the carriage lies against the sloped bottom 66 and the discharge outlet 70 into the cabinet 12 is open.

In order for a member of the public to load trash, the hand grip 86 is pulled downwardly, to the position shown in dashed lines in FIG. 2. A predetermined stop for such position is effected by engagement between the distal panel 78 and an upper edge of the discharge outlet 70. In such position, a member of the public may insert or load onto the carriage, i.e. the inner faces of the proximal and distal panels 76, 78, a trash load of a maximum permitted size and volume, with such size and volume being predetermined by the dimensions of the carriage and the vestibule.

The flange 88 serves as an edge guide for maintaining the trash load within the carriage and also serves to prevent access to the discharge outlet 70 by a member of the public when the carriage is in an intermediate position.

When the lid (proximal panel 76) is closed, the proximal panel lies in a vertical plane and the distal panel is sloped downwardly, resting against the sloped bottom 66 of the vestibule. In such position, the trash load slides freely through the discharge outlet 70 and drops into the container 38.

In accordance with the present invention, the compactor 10 includes a control system which incorporates numerous operational safeguards.

Figure 3:
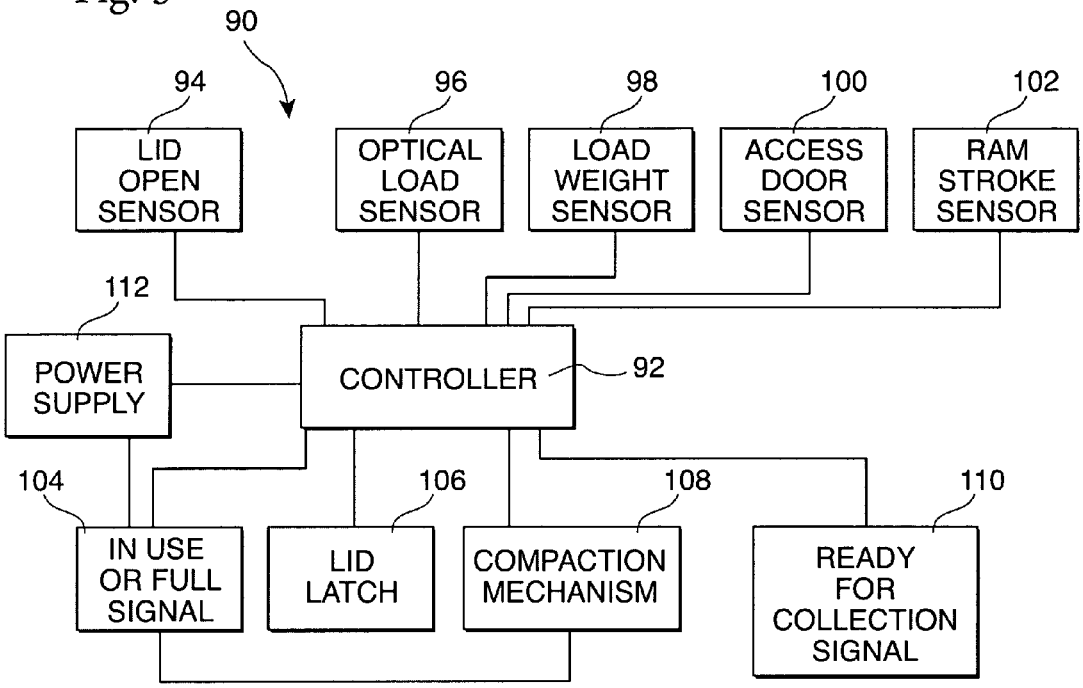
FIG. 3 is a schematized illustration of a trash compactor control system including a controller having a plurality of sensor inputs as well as outputs for actuation of the compaction mechanism, a safety lid latch and a signal for collection of compact trash.

Referring now to FIG. 3, it should be noted that the control system 90 includes a system controller 92, which receives inputs by polling various strategically positioned sensors including, for example, a lid open sensor 94, an optical load height sensor 96, a load weight sensor 98, an access door sensor 100 and a ram stroke sensor 102.

Signal outputs of the controller 92 may be coupled to an "in use" or "full" signal 104 which cautions the public against attempting to pull the lid, a lid safety latch 106, which prevents opening the lid when the compaction mechanism is operating or when the container load is full, a compaction mechanism 108 and a ready for collection signal 110, which may comprise an optical signal and/or a radio transmitted signal.

In operation, the controller 92 continuously monitors the load sensor 96 and determines when the compaction mechanism 108 is to proceed with a compaction cycle by sensing the height of the trash load in the container 38.

The controller 96 actuates the compaction mechanism 108 to extend through a compaction cycle after verifying that the lid is not opened (sensor 94) and after actuating the lid latch 106, to prevent a member of the public from opening the lid during the compaction cycle. The controller 92 additionally actuates an "in use" signal 104 to notify the public that the compactor will not currently accept trash.

The controller 92 also determines when the compacted trash load carried in the container 38 is ready for collection by accessing for example, the weight load sensor 98 or the ram stroke sensor 102.

If the controller 92 determines that the trash load is full, it actuates the ready for collection signal 110, which will advise a trash collector to empty the trash load either by viewing an optical signal or by radio transmission.

Upon the access door sensor 100 sensing that the access door or the lock 42 has been opened, the controller 92 enters an appropriate safety interlock to assure that the compaction mechanism will not operate, except for overriding servicing procedures.

Figure 4:
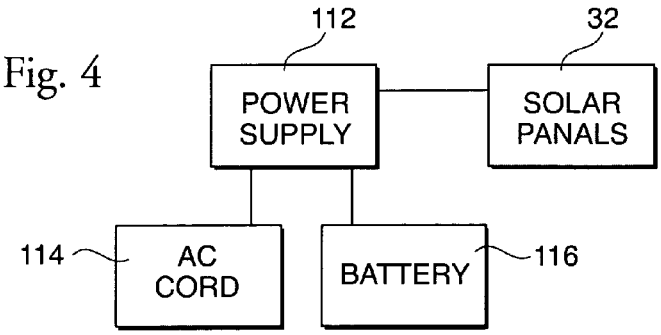
FIG. 4 is a schematized illustration of a trash compactor power supply indicating alternate and/or conjunctive power sources.

Referring now to FIG. 4, wherein the power supply 112 is depicted in schematized format together with various adjuncts thereof, it should be noted that the compactor 10 can be operated utilizing a standard AC power cord 114. The power cord 114 is also utilizable for the purpose of energizing an internal circuit to charge a storage battery 116, such that the compactor may be operated on battery power when positioned in a public area inaccessible to a conventional power outlet. Alternately or conjunctively, the battery 116 may be charged through utilization of the conveniently positioned solar panels 32.

It should be appreciated that the vestibule 60 need not project forwardly of the front panel 14. The front panel 14 may be flush, with the vestibule extending internally into the cabinet, for example.

Thus it will be seen that there is provided a public access trash compactor which achieves the various aspects features and considerations of the present invention and which is well suited to meet the conditions of practical usage.

As various changes might be made in the public access trash compactor as above set forth without departing from the spirit of the invention, it is to be understood that all matter herein described or shown in the accompanying drawings is to be interpreted as illustrative and not in a limiting sense.

Having thus described the invention there is claimed as new and desired to be secured by Letters Patent:

1. A self-contained public access trash compaction system, the system comprising a freestanding cabinet, a trash compaction mechanism within the cabinet, the cabinet including a trash compaction compartment, the cabinet having a front surface, a trash loading vestibule, the vestibule projecting forwardly of the front surface, the vestibule including a planar top wall, a pair of side walls, a downwardly sloped bottom wall and an upper panel, the interior of the vestibule defining a downwardly sloped passageway, the vestibule having an entrance and a discharge outlet, the entrance being defined by forward edges of the top, side and bottom walls, the entrance being at a higher elevation than the discharge outlet, the upper panel extending between the entrance and the discharge outlet along a continuous curve a trash loading carriage pivotally connected to the vestibule adjacent a lower edge of the entrance, the carriage including a first panel and a second panel, the second panel being positioned between the side walls, the first panel comprising a lid which blocks the vestibule entrance when the lid is closed and the carriage is in a first position, the second panel blocking the discharge outlet when the carriage is pivoted to a second position wherein the lid is open and trash may be deposited upon the carriage, whereby when the carriage is pivoted to return to the first position, trash deposited on the carriage is discharged through the discharge outlet and into the trash compaction compartment for compaction by the trash compaction mechanism.

2. A public access trash compaction system as constructed in accordance with claim 1 wherein the trash loading carriage is biplanar and unitary.

3. A public access trash compaction system as constructed in accordance with claim 1 wherein the front surface comprises a panel.

4. A public access trash compaction system as constructed in accordance with claim 1 wherein the carriage includes laterally projecting journals, each journal being seated in a bearing surface of a side wall, whereby the carriage pivots between the first position and the second position.

5. A public access trash compaction system as constructed in accordance with claim 1 further including a trash container, the trash container being positioned in the trash compaction compartment, the trash discharged into the trash compaction compartment being deposited in the trash container, the compaction mechanism including a ram, the ram being actuated to compress the trash deposited in the container.

6. A public access trash compaction system as constructed in accordance with claim 1 further including a battery power supply operatively connected to the trash compaction mechanism, whereby the cabinet may be strategically positioned in a public place remote from an electrical outlet.

7. A public access trash compaction system as constructed in accordance with claim 1 further including a controller for controlling the operation of the compaction mechanism and a sensor for detecting when the deposited trash is in need of compaction, the sensor being operatively connected to the controller, the controller automatically operating the compaction mechanism when the deposited trash is in need of compaction.

8. A public access trash compaction system as constructed in accordance with claim 1 further including a controller, a sensor for determining whether the volume of compacted trash within the cabinet has reached a predetermined level, the controller being operatively coupled to the sensor, the system further including a signal device for indicating that compacted trash is in need of collection, the signal device being operatively coupled to the controller, the controller determining when the trash load has reached the predetermined level and actuating the signal device upon such occurrence.

9. A public access trash compaction system as constructed in accordance with claim 1 further including a flange extending along an edge of the lid, the flange extending to the trash discharge outlet passageway when the lid is partially opened, the flange for preventing access into the when the lid is partially opened.

10. A public access trash compaction system as constructed in accordance with claim 9 wherein the flange extends along an upper edge of the lid, whereby trash deposited upon the carriage is guided by the flange into the discharge outlet when the carriage is pivoted from the second position to the first position.

11. A public access trash compaction system as constructed in accordance with claim 10 wherein the flange is curved to mate with the continuous curve of the upper panel.

12. A public access trash compaction system as constructed in accordance with claim 5 wherein the ram is positioned at a elevation higher than the discharge outlet when trash is discharged into the trash compaction compartment.

13. A public access trash compaction system as constructed in accordance with claim 6 wherein the cabinet comprises at least one panel having a sloped surface, the sloped surface carrying a solar panel, the solar panel being operatively connected to the battery for charging the battery.

14. A public access trash compaction system for use by the general public, the system comprising a freestanding cabinet having a front surface, a trash compaction mechanism within the cabinet, the cabinet including a trash compaction compartment, a trash loading vestibule extending forwardly of the front surface, the vestibule including a trash loading entrance and a discharge outlet, the discharge outlet for discharging trash into the trash compaction compartment, the trash loading entrance being at a higher elevation than the discharge outlet, a lid selectively closing the trash loading entrance, a flange extending along an upper edge of the lid and into the vestibule when the lid is positioned to close the trash loading entrance, the flange precluding access to the discharge outlet when the lid is partially opened, a panel selectively closing the discharge outlet when the lid is positioned to open the trash loading entrance and selectively opening the discharge outlet when the lid is positioned to close the trash loading entrance, whereby a trash load placed in the vestibule will be discharged into the trash compaction compartment when the lid is closed.

15. A public access trash compaction system for use by the general public as constructed in accordance with claim 14 wherein the front surface comprises a panel of the cabinet.

16. A public access trash compaction system for use by the general public as constructed in accordance with claim 14 further including a trash loading carriage, the carriage comprising the lid and the panel.

17. A public access trash compaction system for use by the general public as constructed in accordance with claim 16 wherein the carriage is mounted for pivotal movement relative to the vestibule.

18. A method of providing safe access by the general public to a trash compactor for the deposit of trash, the method comprising the steps of:

a) providing a self-contained freestanding trash compactor having a trash loading entrance and a trash discharge outlet for discharging trash into a trash compaction compartment, b) providing a confined trash passageway between the trash loading entrance and the trash discharge outlet, the passageway being dimensioned to accommodate a trash load of a predetermined maximum size, c) providing a lid for opening and closing the trash loading entrance, the lid including a flange extending along an upper edge of the lid and into the trash loading entrance when the trash loading entrance is closed, d) opening the lid to access the trash loading entrance and closing the trash discharge outlet while blocking access to the trash discharge outlet with the flange when the lid is partially opened, e) depositing a trash load in the passageway, and f) discharging the trash load into the trash compaction compartment after closing the trash loading entrance and opening the trash discharge outlet.

* * * * *